United States Patent [19]

Dunphy et al.

[11] Patent Number: 4,639,022

[45] Date of Patent: Jan. 27, 1987

[54] SLIDING WINDOW OR DOOR LOCK

[75] Inventors: Gerald F. Dunphy, Glen Waverley; Lance E. Best, Vermont South, both of Australia

[73] Assignee: Ogden Industries Pty Ltd, Victoria, Australia

[21] Appl. No.: 677,608

[22] Filed: Nov. 30, 1984

[30] Foreign Application Priority Data

Nov. 30, 1983 [AU] Australia ..... PG 2638/83

[51] Int. Cl.[4] ..... E05C 1/04; E05B 65/08

[52] U.S. Cl. ..... 292/150; 70/100; 70/451; 70/462; 292/DIG. 46; 411/55; 411/60

[58] Field of Search ..... 70/89, 90, 99, 100, 70/462, 466, 461, 451, 448; 292/DIG. 46, DIG. 47, 150, 337; 411/60, 182

[56] References Cited

U.S. PATENT DOCUMENTS

| | | | |
|---|---|---|---|
| 2,936,015 | 5/1960 | Rapata | 411/182 |
| 3,034,328 | 5/1962 | Rifkin | 70/90 |
| 3,779,588 | 12/1973 | Raymon | 292/DIG. 46 X |
| 3,869,887 | 3/1975 | Zeit | 70/100 |
| 3,877,261 | 4/1975 | Robins | 292/337 X |
| 3,936,083 | 2/1976 | Bright | 292/150 X |
| 4,033,157 | 7/1977 | Williams | 292/169.18 X |
| 4,391,559 | 7/1983 | Mizusawa | 411/60 |
| 4,423,897 | 1/1984 | Williams | 292/DIG. 46 X |
| 4,434,634 | 3/1984 | Dunphy et al. | 292/153 X |

*Primary Examiner*—Robert L. Wolfe
*Assistant Examiner*—Russell W. Illich
*Attorney, Agent, or Firm*—Berman, Aisenberg & Platt

[57] ABSTRACT

A lock for a sliding window or door and having a body which is adapted to be secured to either an outwardly facing surface or a laterally facing surface of the movable frame of the window or door. The lock includes a locking bar which is slidably mounted on the lock body for relative movement into and out of an operative position at which it projects beyond a back surface of the lock body and engages within a hole in the fixed frame of the window or door. The lock body is secured to the movable frame by means of fastening screws extending through bores formed through a mounting part of the body and those bores include primary bores which extend in the front to back direction and secondary bores which extend laterally through the mounting part. The primary bores are used if the body is to be secured to the outwardly facing frame surface and the secondary bores are used if the body is to be secured to the laterally facing frame surface. The fixing means may include an expandable nut located in the movable frame and which is expanded into tight engagement with that frame by interaction between an end of the screw and a tapered section of a bore of the nut.

15 Claims, 13 Drawing Figures

SLIDING WINDOW OR DOOR LOCK

This invention relates to locks for sliding windows and doors and is particularly concerned with such locks of the kind having a slidable pin or bar which functions something in the manner of a deadbolt. Although such locks have their principal application in relation to doors and windows they may be used to secure other types of sliding members and the present invention is to be understood as extending to such other uses.

Australian patent application No. 77670/81 is concerned with a lock of the foregoing kind and although that lock is effective in operation it is of such a nature that it cannot be conveniently used in some applications. Those applications generally involve metal frame windows and doors and particularly situations in which the frames are composed of relatively narrow sections of extruded aluminium. In such situations, it is either not possible or not convenient to have the locking bar arranged to penetrate the movable frame of the door or window, whereas that is the type of arrangement to which the lock of the aforementioned patent application is particularly suited.

Other similar locks such as that forming the subject of Australian patent application No. 69019/81 are suited for mounting on the movable frame and locking by engagement with a fixed frame. Those locks are generally unsatisfactory however, because they can be mounted one particular way only. There are applications for which the particular manner of mounting of those locks is not suitable. Such prior locks suffer other disadvantages such as difficulty to install and, in some cases, insecure mounting. A further generally universal problem is that of adapting such locks to suit frames of various styles and sections.

It is an object of the present invention to provide a lock of the foregoing kind which is usable in a wide variety of situations. It is a further object of the invention to provide such a lock which is usable with metal frames of various sizes and configurations. It is yet another object of the invention to provide such a lock which can be securely mounted.

According to the present invention, there is provided a lock including a body which is adapted to be secured to one of two relatively movable members, said body having a mounting part and an actuator part, a locking bar mounted on said actuator part for relative axial movement between an operative position in which an end portion of said bar projects beyond a back surface of said actuator part for location within a hole provided in the other of said two members and an inoperative position in which said end portion does not so project, locking means carried by said actuator part and being operable to hold said locking bar against movement from the operative to the inoperative position, said mounting part projecting laterally from one side of said actuator part in a direction transverse to the longitudinal axis of said bar, at least one primary fastening bore extending through front and back surfaces of said mounting part, and at least one secondary fastening bore extending through said mounting part in a direction transverse to the axis of said primary fastening bore and also transverse to said direction of projection of said mounting part, the arrangement being such that fastening means for securing said body to said one member can be associated with either said primary or secondary bore whereby said body can be secured to a surface of said one member which is either parallel to or transverse to said locking bar axis.

The essential features of the invention and further optional features are described in detail in the following passages of the specification which refer to the accompanying drawings. The drawings, however, are merely illustrative of how the invention might be put into effect, so that the specific form and arrangement of the features (whether they be essential or optional features) shown is not to be understood as limiting on the invention.

IN THE DRAWINGS

Figure 5:
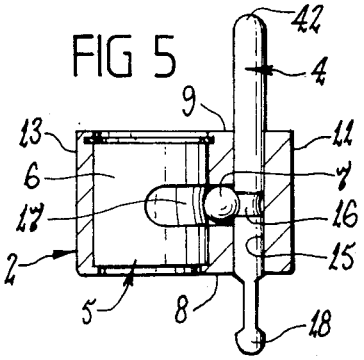
FIG. 5 is a cross sectional view taken along line V—V of FIG. 4.
Figure 6:
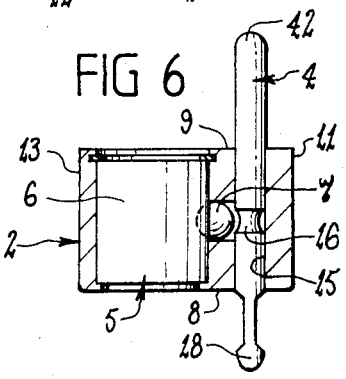
FIG. 6 is a view similar to FIG. 5 but showing the tumbler lock turned to the lock release position.

In the example embodiment shown in the accompanying drawings, the lock body 1 includes an actuator part 2 and a mounting part 3. The actuator part 2 carries the locking bar 4 and means 5 for releasably locking that bar 4 in its operative position (FIG. 2), and the mounting part 3 is arranged to be secured to the particular frame of adoor or window which is to carry the lock body 1. Preferably, the locking means 5 is generally of a kind disclosed in patent application No. 77670/81. That is, as shown in FIGS. 5 and 6, it preferably includes a key operated pin tumbler-type mechanism having a rotatable barrel 6 which acts on the locking bar 4 through the intermediary of a metal ball 7. It is to be appreciated however, that other locking arrangements may be adopted.

According to the arrangement shown, the actuator part 2 is a block-like member having front and back sides 8 and 9 respectively and four peripheral sides 10, 11, 12 and 13. The mounting part 3 of that example arrangement is an elongate member of square or rectangular section extending laterally outwards from the peripheral side 10 which, for convenience, will be hereinafter called the upper side of the actuator part 2. Other configurations of the lock body 1 are possible and consequently the foregoing is to be understood as an example configuration only.

The rotatable barrel 6 of the locking mechanism 5 is preferably mounted in the actuator part 2 as shown so that the key-way entrance 14 is exposed at the front side 8 of that part 2. The pin tumblers (not shown) are arranged to coact between the barrel 6 and the actuator part 2 as they would coact between the barrel and cylinder of a conventional pin tumbler cylinder lock. Any suitable means may be employed to hold the barrel 6 against extraction from the lock body 1.

It is preferred, for a reason hereinafter made clear, to locate the locking bar 4 as close as possible to the lower side 12 of the actuator part 2, and the bar 4 is slidably mounted in a bore 15 (FIGS. 5 and 6) passing completely through the front and back sides 8 and 9 of the actuator part 2. In the form shown, the bar 4 is of circular cross section and the bore 15 is of corresponding cross section. The longitudinal axes of the bar 4 and lock barrel 6 respectively are substantially parallel and the respective bores of the lock body 1 containing those members are laterally spaced apart to provide a space to contain the ball 7 as shown in FIGS. 5 and 6.

As in the construction according to patent application No. 77670/81, a portion of the locking mechanism ball 7 can locate within a circumferential recess or groove 16 of the locking bar 4 so as to hold that bar 4 against movement from its operative position. A cam surface 17 of the barrel 6 is operative to hold the ball 7 in the bar locking position (FIG. 5) or to release the ball 7 for movement away from the bar 4 (FIG. 6), according to the rotational position of the barrel 6.

Any appropriate means may be employed to restrain the bar 4 against removal from the lock body 1. For example, a head 18 of the bar may engage the front side of the lock body to limit movement in one direction, and a circlip or other device (not shown) secured to the bar 4 may operate to limit movement in the opposite direction.

The mounting part 3 of the lock body 1 is preferably of rectangular cross section as shown and has its greatest depth in the front to back direction. At least one fastening bore 19 extends through the mounting part 3 in the front to back direction and at least one other bore 20 extends completely through that part 3 in a direction normal to that of the bore 19. For convenience of description the bore 19 will be hereinafter called the primary bore and the other bore 20 will be called the secondary bore. The secondary bore 20 passes through the broad side surfaces 21 and 22 of the mounting part 3 which extend between the front and back sides 23 and 24 thereof.

Figure 4:
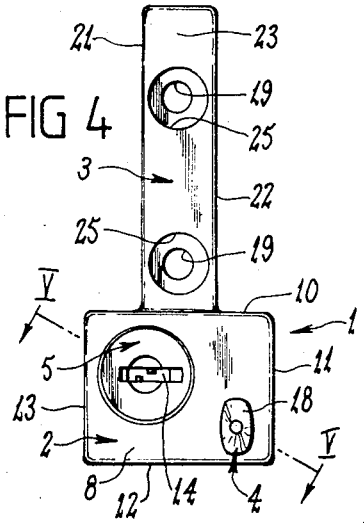
FIG. 4 is a front elevation view of the lock shown in FIG. 1 and showing the tumbler lock turned to the locking position.

Preferably, as shown, there are at least two of each of the primary and secondary bores 19 and 20, and it is further preferred that those bores 19 and 20 do not intersect. The respective bores of each type 19 and 20 are spaced apart in the longitudinal direction of the mounting part 3, which in most circumstances of use is an upright direction. In the particular arrangement shown, each primary bore 19 is counterbored at 25 (FIGS. 4 and 9) from the front side 23 of the mounting part 3 and each secondary bore 20 is screw threaded.

Figure 1:
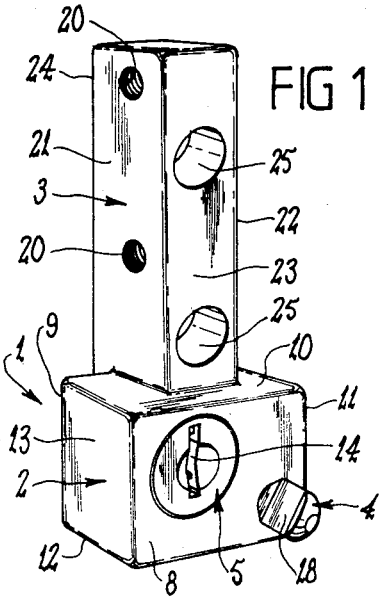
FIG. 1 is a perspective view of one form of lock incorporating the present invention.
Figure 2:
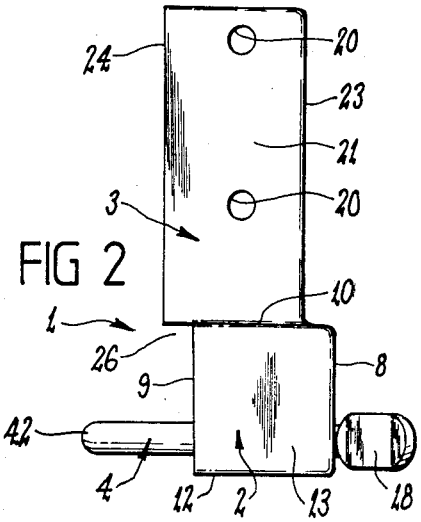
FIG. 2 is a side elevation view of the lock shown in FIG. 1.
Figure 3:
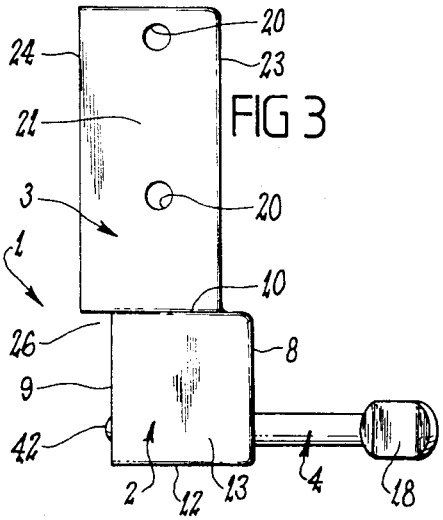
FIG. 3 is a view similar to FIG. 2 but showing the locking bar withdrawn to the inoperative position.

The back side 24 of the mounting part 3 may be stepped rearwardly beyond the correponding side 9 of the actuator part 2 as shown in FIGS. 2 and 3. That facilitates mounting the lock body 1 as described below and the depth of the step 26 is preferably predetermined to be substantially the minimum to be expected to be necessary in normal circumstances.

In most applications of the lock, it is intended that the mounting part 3 be secured to the movable member (e.g., door or window) and that the actuator part 2 overlie a surface of a relatively fixed member. By way of example, in the case of a sliding window 27 as shown in FIGS. 7 and 8, the mounting part 3 is secured to an upright section 28 of the movable frame 29 of the window 27 and the actuator part 2 is arranged to overlie and traverse across a lower horizontal section 30 of the fixed frame 31 which may or may not constitute part of the guide channel 32 (FIG. 9) within which the movable frame 29 slides.

Figure 7:
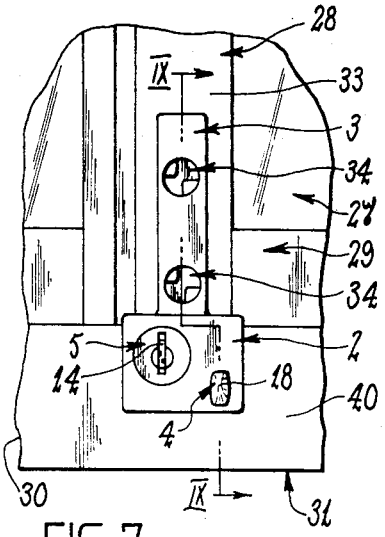
FIG. 7 is a view of portion of a sliding window to which is attached a lock as shown in FIG. 1.
Figure 8:
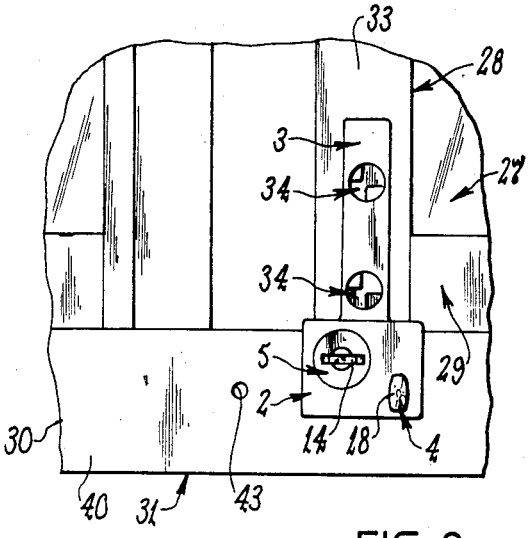
FIG. 8 is a view similar to FIG. 7 but showing the window partially open.
Figure 9:
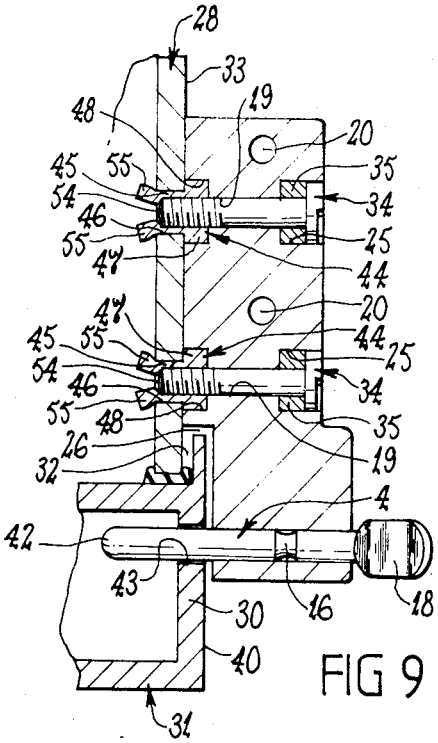
FIG. 9 is a cross sectional view taken along line IX—IX of FIG. 7.

FIGS. 7 to 9 show the lock body 1 secured to an outwardly facing surface 33 of the upright section 28 of the movable frame 29, and for that purpose fixing screws 34 are installed through the primary bores 19 of the mounting part 3. The screws 34 may be of the self-tapping kind, but that usually requires substantial care in the drilling of appropriate holes in the movable frame section 28. An alternative form of fixing which is very secure and requires less care for preparation, involves the use of expandable nuts as hereinafter described.

Whatever form of fixing screw 34 is adopted, the length of those screws 34 is preferably predetermined to be the minimum believed to be appropriate for the known applications of the lock. Also, the depth of the counterbores 25 is predetermined to allow the screws 34 to project beyond the back surface 24 of the mounting part 3 to the maximum extend believed necessary for the aforementioned known applications. Should it be necessary in any particular situation to reduce the extent of that projection, a spacer collar 35 (FIG. 9) of suitable length may be located within the counterbore 25 between the base of that counterbore and the head of the screw 34. Such collars 35 could be formed of plastic material, and a plurality of such collars 35 of various lengths may be provided as part of an accessory kit which accompanies the lock.

Figure 13:
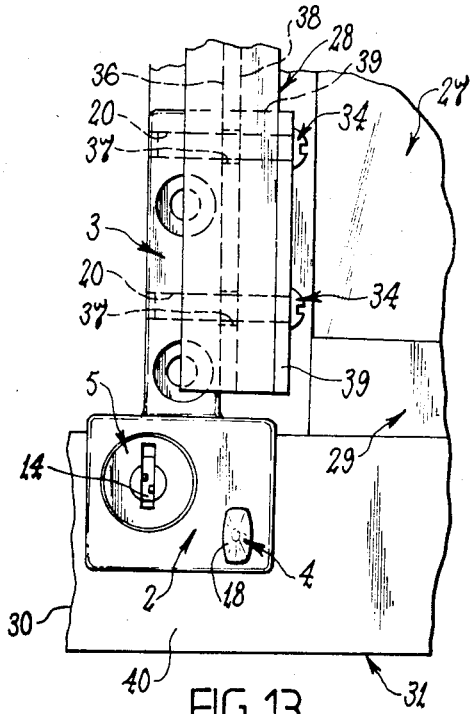
FIG. 13 shows one possible arrangement of a lock according to the invention attached to a laterally facing surface of a sliding window frame.

In the event that the lock body 1 must be secured to a side surface 36 of the movable frame section 28 as shown in FIG. 13, the fixing screws 34 are preferably passed through clearance holes 37 drilled in that section to pass completely therethrough. The screws 34 are therefore passed through the frame section 28 from one side 38 and threaded into the secondary bore 20 of the mounting part 3, which is located on the other side 36 of the frame section 28. In some applications, a spacer plate 39 of suitable thickness may be provided between the heads of the screws 34 and the adjacent side 38 of the frame section 28, and that plate 39 can also form part of the aforementioned accessory kit.

The outwardly facing surface 33 of a movable frame 29 is generally inwardly stepped from the corresponding surface 40 of the lower horizontal or sill section 30 of the fixed frame 31. The step 26 at the lower side of the lock body 1 may be predetermined to allow for the minimum distance expected between those two frame surfaces 33 and 40. If a greater distance is encountered in any situation, one or more packing plates 41 can be provided at the back side 24 of the mounting part 3 and a plurality of such plates 41 may form part of the lock kit. The spacing plates 39 may constitute one such packing plate 41.

Packing at the back side 24 of the mounting part 3 may be also required to limit penetration of the locking bar 4 into the fixed frame 31. In some circumstances reduced penetration may be necessary to avoid the inner end 42 of the bar 4 fouling with the movable frame 29. The low location of the locking bar 4 on the lock body 1 also helps to guard against such fouling, but in some circumstances that alone may not be sufficient.

Preparation of the movable frame 29 to receive the lock body 1 may be facilitated by providing a centre-punch (not shown) as part of the lock body. At least the end portion of that punch adjacent the pointed end thereof is preferably of a diameter such as to be a sliding fit within the secondary bores 20 of the lock body 1. Thus, if those bores 20 are to be used for mounting the lock body 1, that body 1 can be held at the desired position against the movable frame 29 and the centre-punch can be utilized to mark the position at which holes should be drilled through that frame 29.

It is preferred that the punch is stepped to have a larger diameter remote from the pointed end and that diameter is preferably a sliding fit within the counterbore 25 of the primary bores 19. Thus, the punch can be used to mark the position of holes to be drilled to suit mounting by way of the primary bores 19. In some cases, it may be necessary to reduce the effective depth of the counterbore 25 for such purposes in which event a spacer collar 35 as previously described can be utilized.

The inner end 42 of the locking bar 4 may be provided with a small conical pip (not shown) which can act as a centre-punch for marking the position of a hole 43 (FIG. 8) to be drilled to accept that bar 4. Thus, all hole positions can be conveniently and accurately marked to ensure quick mounting of the lock body 1.

Figure 10:
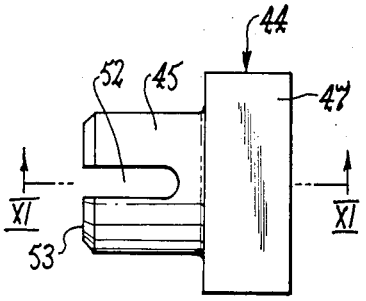
FIG. 10 is a side elevational view of an expandable nut as used in the FIG. 9 arrangement.
Figure 11:
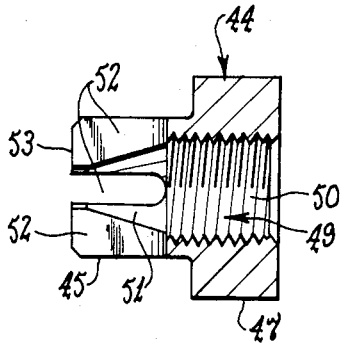
FIG. 11 is a cross sectional view taken along line XI—XI of FIG. 10.
Figure 12:
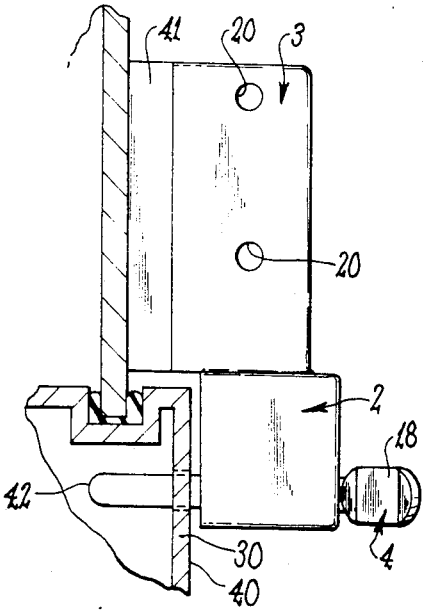
FIG. 12 is a view showing one possible arrangement of a lock according to the invention attached to an outwardly facing surface of a sliding window frame.

As previously stated, expandable nuts may be used to secure the lock body 1 when mounting is effected through the primary bores 19. In one form as shown in FIGS. 10 and 11, such a nut 44 includes a cylindrical shank 45 which is inserted into a hole 46 (FIG. 9) provided in the window frame 29, and an enlarged head 47 which bears against the surface 33 of that frame 29. Preferably, the head 46 is of square or other non-circular peripheral shape so as to locate within a substantially complementary recess 48 (FIG. 9) in the back side 24 of the mounting part 3 and be thereby held against relative rotation. Alternatively, the back side 24 of the mounting part 3 could have a groove of appropriate width to receive the head 47.

An axial bore 49 extends completely through the nut 44 and comprises a threaded section 50 and a tapered or conical section 51. The threaded section 50 is at the head end of the bore 49 and the conical section 51 reduces in size away from the head end as shown in FIG. 11. In one form, the conical section 51 has an included angle of approximately 30°, but other tapers may be used.

It is further preferred that the shank 45 of the nut 44 is split by at least one slot 52 extending longitudinally from the terminal end 53 of that shank 45 for substantially the full length of that shank 45. In the arrangement shown, there are four such slots 52 equally spaced around the circumference of the shank 45, but any other number may be adopted.

The arrangement is such that a fastening screw 34 passed through the lock body 1 first engages within the threaded section 50 of the nut bore 49. As the screw 34 is projected beyond that section 50, its terminal end 54 (FIG. 9) bears against the conical surface of the tapered section 51 of the bore 49 so that continued axial movement of the screw 34 is accompanied by radial expansion of the nut shank 45. As shown in FIG. 9, a terminal end part 55 of the nut shank 45 projects axially beyond the inner surface of the frame section 28. The aforementioned radial expansion causes that terminal end part 55 to project radially outwards to overlie part of the inner surface of the frame section 28 as shown in FIG. 9 and as a result the nut 44 is firmly secured within the window frame 29 and the lock body 1 is in turn firmly attached to the frame 29. It will be appreciated that the radially expanded shank 45 firmly grips within the associated hole 46 as well as having part overlying and engaging the inner surface of the frame section 28.

Although the tapered section 51 of the bore 49 has been described as conical, that is not necessary. Indeed, it would be sufficient to have two opposed flat and relatively sloping surfaces between which the screw 34 could move. Any suitable material may be used to form the nut 44, such as aluminium alloy. Although the nut is particularly suited for the application described, it clearly has other uses.

The lock described above has several advantages over prior constructions, but it is particularly characterized in its ability to be conveniently mounted in any one of a variety of situations. The range of application of the lock is therefore larger than for prior locks of the same general kind.

Various alterations, modifications and/or additions may be introduced into the constructions and arrangements of parts previously described without departing from the spirit or ambit of the invention as defined by the appended claims.

Having now described our invention what we claim as new and desire to secure by Letters Patent is:

1. A lock including a body which is adapted to be secured to one of two relatively movable members, said body having a mounting part and an actuator part, a locking bar mounted on said actuator part for relative axial movement between an operative position in which an end portion of said bar projects beyond a back surface of said actuator part for location within a hole provided in the other of said two members and an inoperative position in which said end portion does not so project, locking means carried by said actuator part and being operable to hold said locking bar against movement from the operative to the inoperative position, said mounting part projecting laterally from one side of said actuator part in a direction transverse to the longitudinal axis of said bar, and having four sides which extend in that direction, two of said four sides constituting substantially parallel front and back sides of the mounting part and each of the other two said sides extends between said front and back sides in substantially parallel relationship, said front and back sides being spaced apart in the axial direction of said locking bar, at least one primary fastening bore extending through said front and back sides of the mounting part, and at least one secondary fastening bore extending through said other sides of the mounting part in a direction transverse to the axis of said primary fastening bore and also transverse to said direction of projection of said mounting part, the arrangement being such that said lock can be secured either to an outwardly facing surface of said one member or to a surface which extends transverse to said outwardly facing surface, and in the former case said mounting part projects outwardly from said outwardly facing surface and is secured thereto by fastening means (for securing said body to said one member can be associated with either said primary or secondary bore whereby said body can be secured to a surface of said one member which is either parallel to or transverse to said locking bar axis) extending through said primary fastening bore, whereas in the latter case said mounting part is located to one side of said outwardly facing surface and is secured to said transverse surface by fastening means extending through said secondary bore.

2. A lock according to claim 1, wherein said mounting part is elongate in said direction of projection thereof and is of rectangular shape in transverse cross section, and the narrower side surfaces of said mounting part form said front and back surfaces thereof.

3. A lock according to claim 2, wherein the back surface of said mounting part is located rearwardly beyond the back surface of said actuator part.

4. A lock according to claim 1, wherein said locking bar is slidably mounted in a bore extending through said actuator part and said bore is located adjacent the side of said actuator part remote from said one side thereof.

5. A lock according to claim 1, wherein said locking means includes a key operated tumbler lock having a barrel rotatably mounted in said actuator part.

6. A lock according to claim 1, wherein there is a plurality of each of said primary and secondary fastening bores and each two adjacent fastening bores are spaced apart in said direction of projection of the mounting part.

7. A lock according to claim 6, wherein each said secondary fastening bore is screw threaded.

8. A lock according to claim 1, wherein said fastening means includes an expandable nut located at the back surface of said mounting part and a fastening screw which is extendable through a said fastening bore to cooperatively engage with said nut, said nut having an expandable section which is locatable within a complementary hole of said support and a head section which cooperates with another part of said lock so that the nut is held against rotation relative to said lock body, anaxial bore extending through said nut and comprising a threaded section and a tapered section which reduces to a size smaller than the minimum diameter of said threaded section, and said expandable section is arranged to radially expand in response to penetration of said screw into said tapered section.

9. A lock according to claim 8, wherein said expandable section is substantially cylindrical and includes at least one longitudinally extending slot which weakens said cylindrical section to facilitate said radial expansion thereof.

10. A lock according to claim 8, wherein said other part is a back part of said lock body having a recess which receives said head section and cooperates therewith to hold the nut against relative rotation.

11. A lock according to claim 2 in combination with and secured to a movable frame of a sliding closure for an opening, said movable frame forming said one member and said back surface of the mounting part faces towards said one member surface, said fastening means is associated with said primary fastening bore, at least a portion of the back surface of said actuator part overlies portion of a surface of a fixed frame which forms said other member and which surrounds said opening, said fixed frame surface lies in a plane substantially parallel to the direction of sliding movement of said movable frame, and said locking bar is projectable through said back surface portion of the actuator part so as to engage within a hole in said fixed frame.

12. A lock and sliding closure combination according to claim 11, wherein said fastening means includes an expandable nut and a fastening screw, said nut having an expandable section which is located within a hole in said movable frame and a head section which is located within a recess at the back surface of said mounting part, said head section and said recess cooperating to hold said nut against rotation relative to said mounting part, an axial bore extending through said nut and having a threaded section adjacent said mounting part and a tapered section remote therefrom, said fastening screw cooperatively engaging within said threaded section and engaging within said tapered section with interference so as to cause radial expansion of the expandable section and thereby secure said nut to the movable frame.

13. A lock according to claim 2, in combination with and secured to the movable frame of a sliding closure for an opening, said movable frame forming said one member and a longitudinally extending side surface of said mounting part faces towards said one member surface, said fastening means is associated with said secondary fastening bore, at least a portion of the back surface of said actuator part overlies portion of a surface of a fixed frame which forms said other member and which surrounds said opening, said fixed frame surface lies in a plane substantially parallel to the direction of sliding movement of said movable frame, and said locking bar is projectable through said back surface portion of the actuator part so as to engage within a hole in said fixed frame.

14. A lock and sliding closure combination according to claim 12, wherein a terminal end part of said expandable section projects radially beyond a surface of said movable frame remote from said head section, and said radial expansion causes said terminal end part to project radially so as to overlie part of said movable frame surface.

15. In an assembly of a slideable closure for an opening and a lock, the improvement wherein the lock is a lock according to claim 2 secured to a movable frame of the closure which has an outwardly facing surface and forms the one member, the back side of the mounting part faces towards the outwardly facing surface, the fastening means is associated with said primary fastening bore, at least a portion of the back surface of said actuator part overlies portion of a surface of a fixed frame which forms said other member and which surrounds said opening, said fixed frame surface lies in a plane substantially parallel to the direction of sliding movement of said movable frame, and said locking bar is projectable through said back surface portion of the actuator part so as to engage within a hole in said fixed frame.

* * * * *